US007997334B2

(12) United States Patent
McCorry

(10) Patent No.: US 7,997,334 B2
(45) Date of Patent: Aug. 16, 2011

(54) APPARATUS AND METHOD

(75) Inventor: Mark McCorry, Aberdeen (GB)

(73) Assignee: Phuel Oil Tools Limited, Aberdeen (GB)

( * ) Notice: Subject to any disclaimer, the term of this patent is extended or adjusted under 35 U.S.C. 154(b) by 121 days.

(21) Appl. No.: 12/146,875

(22) Filed: Jun. 26, 2008

(65) Prior Publication Data

US 2009/0000783 A1 Jan. 1, 2009

(30) Foreign Application Priority Data

Jun. 28, 2007 (GB) ..... 0712528.9

(51) Int. Cl.
*E21B 19/00* (2006.01)

(52) U.S. Cl. ..... 166/84.1; 166/84.4; 166/88.1

(58) Field of Classification Search ..... 166/84.1–84.4, 166/88.1, 88.4, 90.1; 137/247.11, 247.33, 137/251.1

See application file for complete search history.

(56) References Cited

U.S. PATENT DOCUMENTS

| | | | | |
|---|---|---|---|---|
| 1,521,390 A | | 12/1924 | Reynolds | |
| 2,176,323 A | * | 10/1939 | Bowen et al. | 175/214 |
| 3,145,995 A | * | 8/1964 | Adamson et al. | 166/53 |
| 3,943,997 A | | 3/1976 | Davis | |
| 4,235,727 A | * | 11/1980 | Firth, Jr. | 507/107 |
| 4,279,300 A | | 7/1981 | Wirsh | |
| 4,476,924 A | | 10/1984 | Winders | |
| 4,529,210 A | * | 7/1985 | Biffle | 166/84.3 |
| 4,640,372 A | | 2/1987 | Davis | |
| 4,821,799 A | | 4/1989 | Wong | |
| 4,832,128 A | | 5/1989 | Light et al. | |
| 2002/0066562 A1 | | 6/2002 | Nice | |
| 2006/0157282 A1 | | 7/2006 | Tilton et al. | |

FOREIGN PATENT DOCUMENTS

| | | |
|---|---|---|
| EP | 08 01 2835 | 5/2011 |
| GB | 1273509 | 5/1972 |
| GB | 1466677 | 3/1977 |
| GB | 1526952 | 10/1978 |
| GB | 2206912 | 1/1989 |
| WO | WO2005/049956 | 6/2005 |
| WO | WO 2005-049956 A2 | 6/2005 |

* cited by examiner

*Primary Examiner* — Giovanna Wright
(74) *Attorney, Agent, or Firm* — Taft Stettinius & Hollister LLP

(57) ABSTRACT

A method and apparatus for containing fluid in ah area of a wellbore annulus, in which fluid is energized to create a fluid flow which is at least partially obstructed and is directed to form in the annulus a localized area of high pressure to contain fluid in an area of the annulus of lower pressure. In an embodiment, the method creates a pressure plug in the annulus.

26 Claims, 4 Drawing Sheets

APPARATUS AND METHOD

CROSS-REFERENCE TO RELATED APPLICATIONS

This application claims priority under 35 U.S.C. §119 to United Kingdom Patent Application Serial No. 0712528.9 filed on Jun. 28, 2007, entitled "APPARATUS AND METHOD," the disclosure of which is hereby incorporated by reference.

RELATED ART

1. Field of the Invention

The present invention relates to an apparatus and method for creating a localized area of high pressure within a conduit and a method for retaining pressure within an annulus. In an exemplary application, the invention is useful for containing well pressure while performing wireline operations.

2. Brief Discussion of Related Art

When tool strings are deployed through an access hole into a live wellbore there is a need to contain pressurized well fluids and prevent their escape through the annulus between the tool string and the access hole of the wellbore. Sealing of the annulus around slickline (i.e. smooth wire) is currently achieved by compressing a cylindrical rubber to seal against the slickline in the annulus. For braided wire and lines with a rough profile, this type of sealing mechanism is not practical as the surface profile of the wire restricts effective sealing. Instead, a highly viscous fluid such as grease is injected into the annular space around the wife. This creates a seal that prevents the escape of well fluids but without restricting movement of the wire. There can be significant changes in viscosity as a result of temperature increases, which could be detrimental to the ability to contain the well pressure. In addition, there are practical disadvantages to purchasing, storing, handling and disposing of the grease. Grease tends to stick to the wire and as a result when the wire is removed from the well and spooled onto a drum, there can be spills on the deck of the platform leading to an unsafe working environment and environmental contamination.

INTRODUCTION TO THE INVENTION

According to a first aspect of the invention, there is provided a method for containing fluid in an area of a wellbore annulus, the method comprising the steps of:

(a) energizing a fluid to create a fluid flow;

(b) at least partially obstructing the fluid flow; and (c) directing the fluid flow to form in the annulus a localized area of high pressure to contain fluid in an area of the annulus of lower pressure.

Typically, as a result of the obstruction to fluid flow, performance of step (b) causes a back pressure to be generated. The method may include impacting the fluid against a shaped surface to create a back pressure in the annulus, the back pressure being sufficiently high to contain fluid in the wellbore annulus. Thus, the energized fluid may seal the annulus in the localized area of high pressure, such that escape of fluid from regions of ambient pressure is restricted or prevented.

Step (a) can include accelerating the fluid flow. Step (a) can also include increasing the speed of fluid to a speed between 20-600 m/s. Step (a) can further include injecting fluid into a channel and shaping the channel to energize the fluid. Step (a) can even further include providing a body having a channel with a fluid inlet and a fluid outlet and shaping the channel to have a lower sectional area in the region of the outlet compared with the inlet such that the velocity of the fluid is increased in the region of the outlet. In this way, the fluid can be formed into a jet. Preferably, the jet has sufficient velocity to overcome the ambient pressure, (for example, the pressure at the outlet of the channel) so that it reaches the obstruction of step (b).

Step (b) can include impeding or placing an impediment in a path of the energized fluid. Step (b) can also include at least partially confining the fluid in a chamber and/or can include at least partially confining the energized fluid in a predetermined area of the annulus. Thus, the chamber may define an annular space.

Steps (b) and (c) can be performed simultaneously. Step (b) can include positioning a surface in the path of energized fluid flow and step (c) can include angling the surface such that flow is directed to generates localized area of higher pressure in a predetermined region.

Step (c) of the method can include deflecting the fluid flow to generate an area of higher pressure in the annulus. The method may include deflecting the fluid flow toward the area of higher pressure. The method may include deflecting the fluid flow to generate a pressure plug in the area of higher pressure. The pressure plug and/or area of high pressure may separate first and second regions of lower pressure, and may restrict of prevent fluid flow between the first and second regions. In particular, the plug and/or area of high pressure may contain, act as a barrier to, seal against, cap and/or act as a fluid wall for well fluid located downhole, and may prevent flow of fluid from the downhole location to a second region uphole in relation to the first region. The first and second regions, thus, may be regions of the wellbore annulus.

The wellbore annulus may be an annular space defined between a wireline or slickline, and an inner wall of a wellbore of other wellbore equipment, for example, a pressure control head, stuffing box, wellbore tubing or open hole formations.

The method can include a further step (d) of collecting fluid as the localized area of higher pressure dissipates to the ambient pressure. The method can further include recycling the fluid in step (d) by performing step (a) on the collected fluid. The method may include circulating fluid into and out of said area for maintaining the area of high pressure spatially and over a period time. Thus, in providing the high pressure area or pressure plug, fluid is moved through the high pressure region. In particular embodiments, where the area of high pressure and/of pressure plug separates first and second regions of lower pressure, the second region is at a lower pressure than that of the first region, to provide for fluid flow or dissipation of fluid from the high pressure region to the second region of lower pressure. In certain embodiments, the high pressure area or pressure plug may form an interface separating the first and second regions. Energized fluid used to create the high pressure area may be collected from the second region of lower pressure for repeat use. Fluid may flow from the high pressure region to the second region in preference to the first region, to maintain the pressure conditions of the high pressure region, whilst containing fluid, in the first region.

The method can involve containing ah ambient pressure in an annulus of a wellbore by performing the method previously described downstream of the intended containment region.

The method can include selecting the parameters for fluid speed and the obstruction such that the localized area of high pressure acts as a plug of high pressure to contain the ambient pressure. Such parameters may include, speed of fluid, direction of fluid flow, channel dimensions, relative position and orientation of the channel to the annulus, relative position and/or orientation of the channel to the angled surface. The method can include selecting a fluid having a viscosity of less than 10 centipoise (0.1 Pa s).

According to a second aspect of the invention, there is provided apparatus for containing a fluid in a wellbore annulus comprising:

a means for energizing a fluid to form a fluid flow; and an obstruction adapted to obstruct the flow of energized fluid; and means for directing the fluid to the wellbore annulus to create in the annulus a localized area of high pressure sufficient to contain fluid in ah area of the wellbore annulus of an ambient pressure.

The obstruction of fluid flow can creates back pressure, by presenting an obstacle to the flow of the fluid. The energized fluid may plug or seal the annulus at said area of high pressure.

The obstruction is formed from a material having an excellent wear resistance.

The fluid can be a low viscosity and/or water-based fluid. The fluid can be water. The water can include additives such as corrosion inhibitors.

The fluid can have a viscosity of around 1-5 centipoise (1-5×10−2 Pa s).

The apparatus may include a channel having a fluid inlet and a fluid outlet wherein the channel has a smaller sectional area in the region of the outlet than that of the inlet to increase fluid velocity in the region of the outlet for jetting the fluid into the localized area of high pressure. More specifically, the means for energizing a fluid can comprise a body having a channel with an inlet for receiving a fluid and an outlet, and wherein at least a portion of the channel converges towards the outlet. The portion of the channel that converges towards the outlet can have a lower sectional area, which increases the velocity of fluid within that portion of the channel. The apparatus and/or body can have a throughbore. The throughbore may be arranged to receive a line and wherein the obstruction can be arranged and/or positioned such that pressure is generated in an annular space between the throughbore and the line. The body and the channel can form asymmetrical concentric nozzle for producing an annular jet of energized fluid.

The obstruction and/or means for directing the fluid may include a deflector insert located in the throughbore. The deflector insert may be removably attached to a main body of the apparatus. The deflector insert and/or inner surface of the throughbore may include an angled and/or shaped surface. The deflector insert and/or inner surface of the throughbore may have an inwardly protruding member, which may in turn include the angled and/or shaped surface placed in the path of energized fluid. Thus, the shaped surface may extend inwardly to partially occlude an annular space which may be formed around a line received in the throughbore.

The obstruction and/or means for directing the fluid may include a nozzle insert located in the throughbore. The nozzle insert may be removably attached to a main body of the apparatus, and together with the main body may define a channel for jetting fluid into the wellbore annulus. The nozzle insert together with the deflector insert may be arranged to help energize, direct and obstruct the fluid to create said high pressure area and/or pressure plug.

The width of the annulus can be approximately 0.05 to 1.0 inch (1.27 to 25.4 mm).

The obstruction can comprise a surface that is angled relative to the direction of fluid flow. The angle of the surface relative to an axis of the conduit can be selected according to the desired application. The angle of the surface relative to an axis of the conduit can be selected to deflect the fluid flow to create an area of localized pressure in the predetermined position. Thus, the apparatus may include a surface in the path of energized fluid flow oriented at an angle relative to the direction of fluid flow for deflecting the fluid toward the annulus to generate the area of high pressure.

The directing means may include a fluid channel. The obstruction and the directing means may together define a geometry which interacts with the energized fluid permitting sufficient pressure build up to generate a pressure plug in the annulus from the energized fluid. The obstruction, together with the means for directing the fluid, may be adapted to create the localized area of high pressure in the annulus. This geometry may facilitate pressure build-up on directing energized fluid to the annulus. The geometry may be based on selected parameters for the fluid flow, such as required fluid flow speeds and/or other parameters.

The surface can be cone-shaped in section. The cone angle can be between 20° and 60° from the axis of the conduit. The cone angle can be defined as the angle of the surface relative top the axis of the conduit. Alternatively, the surface can be lens-shaped and/or concave.

The invention is advantageous for use in a wellbore to contain a pressure within an annulus as it reduces the amount of equipment space required, increases safety margins and reduces contamination of the surrounding environment.

Contact between a high velocity fluid stream and the surface causes a back pressure to be generated. This creates a localized area of high pressure that can be moved to an appropriate position in an annulus of the wellbore by deflecting fluid accordingly. When the pressure generated exceeds the pressure of the wellbore, the area of high pressure is effective in forming a pressure barrier that acts to substantially contain the well pressure.

The annulus can be created by running a line, such as wireline or slickline through a tubing. The line can be selected from the group consisting of: wireline; slickline; and downhole tubing. The annulus may be formed between a wireline and an inner wall of a throughbore for receiving the line.

The inner wall may have a recess, step, angled surface, inwardly protruding member or be otherwise shaped for interacting with a fluid and/or to assist energizing a fluid. The fluid may be jetted into the annulus through the inner wall of the throughbore. Thus, the wall may at least partially act as an obstruction, or a deflector for energized fluid.

The minimum predetermined velocity can be 20 m/s. More preferably, the minimum predetermined velocity can be 40 m/s. Alternatively, the value for the minimum predetermined velocity can be any value up to around 600 m/s, depending on the application and the pressures in the annulus that need to be contained.

Preferably, the fluid has a lower viscosity than a long-chain hydrocarbon, such as grease. Preferably, the fluid has a viscosity around a factor of 100 times less viscous than a long chain hydrocarbon.

The method can include shaping the surface to deflect the fluid to a predetermined region such that the back pressure forms a pressure plug in the annulus. Thus, the method may include shaping a surface for deflecting fluid to a predetermined region in the annulus and thereby facilitate creating the area of higher pressure.

The apparatus may take the form of a pressure control head, a stuffing box and/or any other pressure control apparatus for wellbore tubing.

The second aspect of the invention can include any previously described features or method steps of the first aspect of the invention, where appropriate.

According to a third aspect of the invention there is provided a pressure control head for wellbore tubing. The pressure control head may comprise apparatus according to the second aspect of the invention, and may be adapted to perform the method of the first aspect of the invention.

The pressure control head may include a main body having an axial throughbore for receiving a wireline therethrough, and an insert or cartridge, wherein the main body and the insert together may form a symmetrical concentric nozzle for producing an annular jet of energized fluid to an annular space defined between ah inner surface the pressure control head and the wireline providing a pressure seal against the wireline.

The insert may be removably attached to the main body for facilitating m maintenance. Other components of the apparatus of the second aspect of the invention, for example, the directing means, energizing means and/or the obstruction, may form a part of a removable cartridge or insert.

According to a fourth aspect of the invention there is provided a method for creating a localized area of higher pressure relative to an ambient pressure in a conduit, comprising the steps of:

(a) energizing a fluid;

(b) at least partially obstructing the fluid flow; and (c) directing the fluid flow such that a localized area of high pressure is formed.

According to a fifth aspect of the invention, there is provided an apparatus for creating a localized pressure in a conduit comprising:

a means for energizing a fluid; and an obstruction to obstruct the flow of energized fluid and create ah area of localized pressure.

The fluid may have a viscosity of less than 10 centipoise (0.1 Pa s).

According to a sixth aspect of the invention, there is provided a method for containing a pressure within ah annulus of a wellbore including the steps of:

providing a fluid having a predetermined minimum velocity; and impacting a fluid against a shaped surface such that the impact creates a back pressure sufficient to contain fluids within the annulus of the wellbore.

According to a seventh aspect of the invention, there is provided a method for containing fluid at pressure in a wellbore annulus, the method comprising the steps of directing a flow of fluid to the annulus and obstructing the flow to create in the annulus an area of sufficiently high pressure to restrict escape of fluid from and/or contain fluid within an area of the wellbore annulus of lower pressure.

According to ah eighth aspect of the invention, there is provided a method for containing fluid at pressure in a wellbore annulus, the method comprising the steps of confining fluid in a localized area of the annulus, and pressurizing the fluid in said area sufficiently to restrict escape of fluid from an area of the wellbore annulus of lower pressure.

Any one of the third to eighth aspects of the invention can include any previously described features or method steps of the first and/or second aspects of the invention, where appropriate.

DETAILED DESCRIPTION

The exemplary embodiments of the present invention are described and illustrated below to encompass an apparatus and method for creating a localized area of high pressure within a conduit and a method for retaining pressure within an annulus. Of course, it will be apparent to those of ordinary skill in the art that the embodiments discussed below are exemplary in nature and may be reconfigured without departing from the scope and spirit of the present invention. However, for clarity and precision, the exemplary embodiments as discussed below may include optional steps, methods, and features that one of ordinary skill should recognize as not being a requisite to fall within the scope of the present invention.

Figure 1:
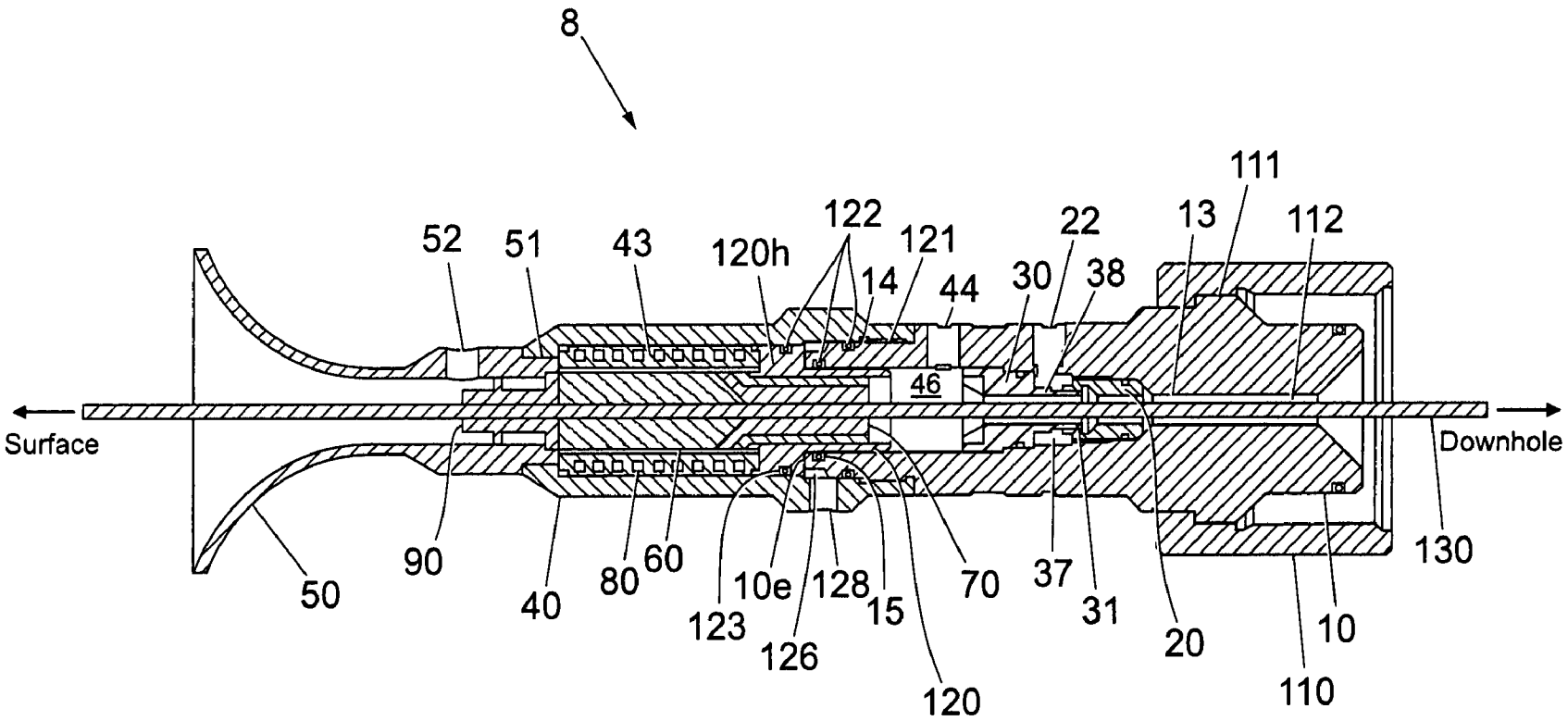
FIG. 1 is a sectional view of a pressure control head.

Referencing FIG. 1, a pressure control head 8 has four main portions: a collar 110; a body 10; a housing 40; and a funnel 50

Figure 2:
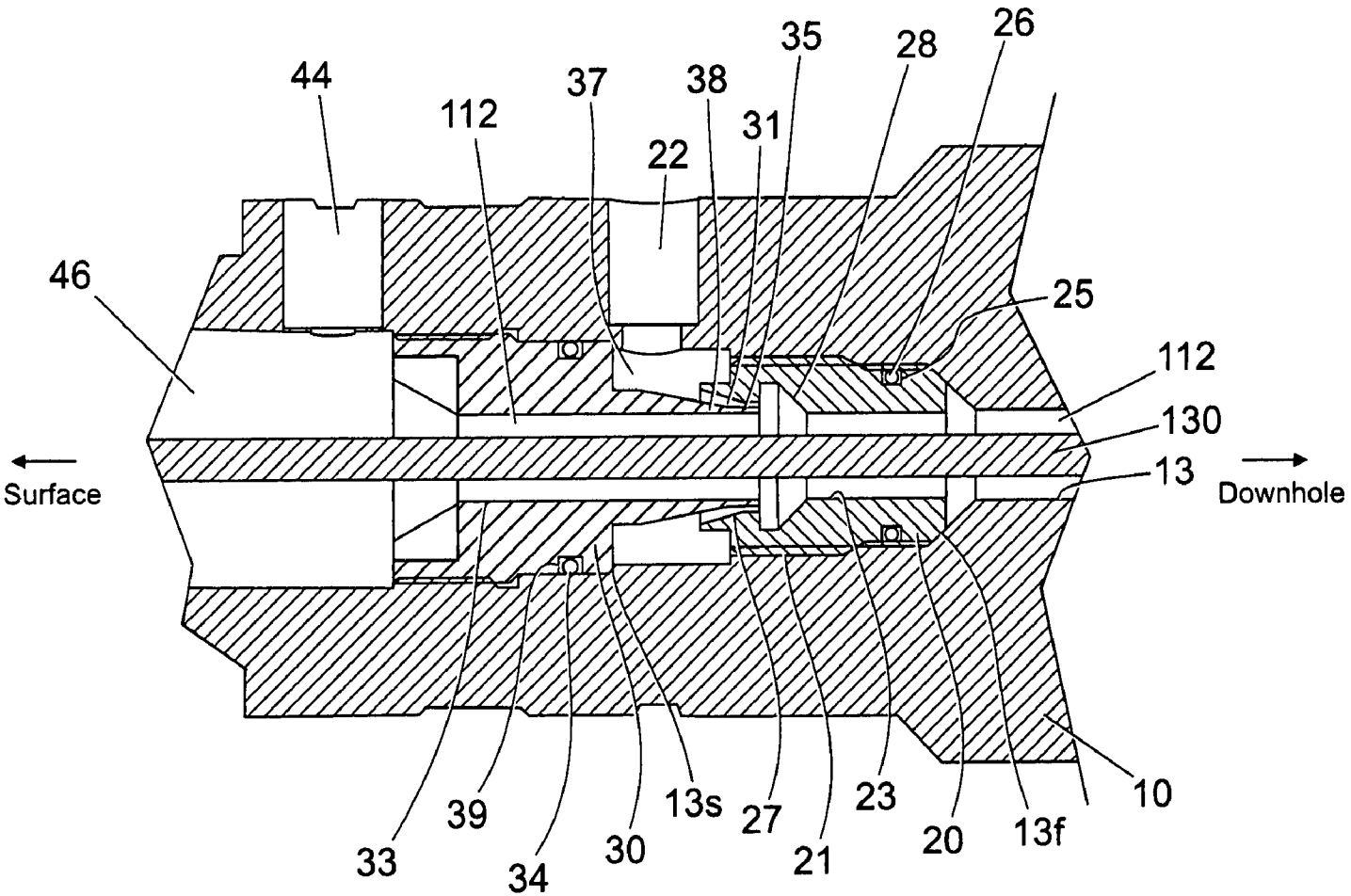
FIG. 2 is a detailed sectional view of a nozzle and a deflector of the pressure control head shown in FIG. 1.

Referring to FIGS. 1 and 2, the collar 110 is connected to the body 10 at a coupling 111. The body 10 is substantially cylindrical and is formed with a centrally disposed throughbore 13 having a flared portion **13*f* for accommodating inserts (described hereinafter). An inlet port 22 extends through a sidewall of the body 10 and an outlet port 44 also extends through the sidewall of the body 10. Both the inlet port 22 and the outlet port 44 are in fluid communication with the throughbore 13**.

As shown in FIG. 2, the flared throughbore portion **13*f* of the body 10 is arranged to receive a deflector insert 20. The deflector insert 20 engages the body 10 by means of a threaded connection 21. An outer surface of the deflector insert 20 is provided with an annular groove 25 that accommodates an annular seal 26 to create a fluid tight seal between the exterior of the deflector insert 20 and the throughbore 13. The deflector insert 20 has a central passageway or throughbore 23 for receiving a wireline. Part of the throughbore 13 is shaped as a frustocone having an impact surface 28 with a cone angle of around 50° relative to its axis of symmetry. At its upper end, the throughbore 23 of the deflector insert 20 opens out into a diverging annular side wall 27. The impact surface 28 of the deflector insert 20** is formed from a ceramic material that has excellent wear resistance.

The flared throughbore portion **13*f* also has an annular step 13*s* positioned adjacent the part of the body 10 where the inlet port 22 communicates with the throughbore 13. A nozzle insert 30 having a central passageway or throughbore 33 for receiving a wireline is positioned within the body 10 so that a portion of the nozzle insert 30 abuts the annular step 13*s*. The nozzle insert 30 is provided with a shaped protrusion 38 at one end that extends into the throughbore 23 of the deflector insert 20. The protrusion 38 of the nozzle insert 30 has an outer annular side wall 35. Together, the outer side wall 35 of the nozzle insert 30 and the annular inner side wall 27 of the deflector insert 20 forms a concentric annular channel that acts as a convergent nozzle 31. An inlet of the nozzle 31 is in communication with an annular chamber 37 and hence the inlet port 22 extending through the sidewall of the body 10. The inlet port 22 is connected to a pump (not shown) to inject fluid through the port 22, into the chamber and the nozzle 31. The exterior of the nozzle insert 30 is provided with an annular groove 39 that accommodates ah annular seal 34 to create a fluid tight seal between the flared throughbore portion 13***f* and the exterior of the nozzle insert 30. Together, the annular seals 26, 34 act to isolate the lower chamber 37 such that fluid entering through the inlet port 22 can only escape via the nozzle 31.

The housing 40 has a box end coupled to a pin end of the body 10, by means of a threaded connection 121. The housing 40 is substantially cylindrical and has a hollow interior 43 that houses an annular piston 120, a seal cone 70, a spring 80 and a wiper 60. The annular piston 120 is substantially cylindrical and one end is slidably disposed in the flared throughbore portion 13*f*. A piston head 120*h* abuts and end face 10*e* of the body 10. An upper chamber 46 is formed in the flared throughbore portion 13*f* between the nozzle insert 30 and the annular piston 120. The upper chamber 46 is in fluid communication with the outlet port 44.

The pin end of the body 10 has an annular groove 14 on its exterior and an annular groove 15 on its interior for accommodating annular seals 122. The exterior of the piston head 120*h* is provided with an annular groove 123 that accommodates an annular seal 122. All the seals 122 fluidly isolate an annular chamber 126 that is in fluid communication with a pump (not shown) via a port 128 extending through a sidewall of the housing 40.

The spring 80 is retained between the housing 40 and the piston head 120*h*, so that the annular piston 120 is resiliently urged to abut the end face 10*e* of the body 10. The seal cone 70 is attached to the piston 120 and has an angled annular face that abuts the wiper 60. The wiper 60 is typically a polymer disposed within the housing 40 and the wiper 60 is compressible by the action of the seal cone 70 thereon.

The funnel 50 has a pin end and is attached to a box end of the housing 40 via a threaded connection 51. The funnel 50 is arranged with its divergent end distal from the housing 40. The funnel 50 is provided with a centralizer 90 for centralizing a wireline running therethrough. The centralizer 90 also acts as a barrier against which the wiper 60 can react under the force of the seal cone 70 acting thereagainst. An outlet port 52 extending through a sidewall of the funnel 50 is provided to recover fluids collected in the funnel 50.

A wireline 130 is shown in FIGS. 1 to 6 centrally disposed in the throughbores 13, 23, 33 of the pressure control head 8. The throughbores 13, 23, 33 of the components making up the pressure control head 8 shown in FIG. 1 form a continuous throughbore that allows a wireline 130 to run unimpeded therethrough. An annular space 112 is created between the wireline 130 and the throughbores 13, 23, 33. The annular space 112 is substantially continuous through the body 10, the deflector insert 20 and the nozzle insert 30.

Prior to use, the pressure control head 8 is assembled in the form shown in FIG. 1. The deflector insert 20 followed by the nozzle insert 30 are screwed into the flared throughbore portion 13*f* of the body 10. The piston 120 is inserted into an upper end of the body 10 such that the end face 10*e* of the body abuts the piston head 120*h*. The spring 80 is compressed between the piston 120 and the funnel 50 prior to making up the connections. Connections 111,121, 51, are made up respectively, between the body 10 and the collar 110, the body 10 and the housing 40 and the housing 40 and the funnel 50. The pressure control head 8 is then incorporated in a downhole tubing string such that the divergent end of the funnel 50 is located upstream of (closer to surface than) the collar 110 that forms the lowermost part of the assembly closest to the downhole environment. The wireline 130 can then be run downhole through the pressure control head 8.

In use when the wellbore is at high pressure e.g. 7500 psi (51.7 MPa), the method of the invention as used to contain these downhole pressures and substantially restrict the escape of downhole fluids via leak paths in the annulus 112 between the throughbores 13, 23, 33 and the exterior of the braided wireline 130. According to the present embodiment, the diameter of the wireline 130 is 0.312 inches (7.9 mm).

As the wireline 130 is being run downhole, the pump connected to the inlet port 22 pumps a working fluid into the chamber 37. The working fluid is water and can be used with some anti-corrosion additives to limit the corrosive potential of the fluid to the wireline 130, the pressure control head 8 and other downhole components. Continued pumping of fluid into the lower chamber 37 forces fluid through the nozzle 31. The dimensions of the nozzle 31 and specifically, the fact that the nozzle 31 converges towards its outlet causes the fluid to accelerate, thereby increasing the speed of the fluid until it exits the nozzle 31 at the outlet in a relatively high velocity jet haying a speed of around 500 m/s. The fluid jet impacts against the impact surface 28, which acts as an obstruction in the path of the jet. The effect of the high velocity fluid impacting against the impact surface 28 is that a large back pressure is generated due to the surface presenting an impediment to the high speed fluid flow. The 50° cone angle of the impact surface 28 deflects the fluid flow towards the wireline 130. A localized area of high pressure is thereby formed in the annulus 112 surrounding the wireline 130. This acts as a pressure plug. The schematic diagram shown in FIG. 3 indicates the direction of fluid flow. Arrows 114 indicate the direction in which the downhole pressures are acting. The pressure plug is at a higher pressure than the downhole pressure and therefore contains the downhole fluids at pressure that would otherwise escape in the direction of the arrows 114.

The fluid exiting the outlet of the nozzle 31 must have sufficient velocity to overcome the pressure acting against the direction of fluid flow (shown by the arrows 114) in the annulus 112. The small containment region between the nozzle 31 outlet, the impact surface 28 and the wireline 130 obstructs the fluid flow and thereby plugs the annulus to prevent the escape of high pressures. The working fluid then dissipates in the annulus 112 and the pressure decreases away from the region of the high pressure plug. Thus, working fluid flows into, through and then out from the region of the high pressure plug toward the chamber 46. The pressure away from the pressure plug near the chamber 46 is at a lower pressure than that of the wellbore fluids contained downhole. Since the working fluid is continuously pumped and circulated through the nozzle 31, the effect of the pressure plug is continuously maintained.

Once the working fluid has dissipated if moves up (and/or down) the annulus 112 and the fluid collected in the chamber 46 is recovered through the outlet port 44. Fluid collected through the port 44 can then be recycled, treated if necessary, and reinjected through the inlet port 22.

The method of the invention can be used both as the wireline 130 is run downhole and pulled from the wellbore.

In the case where the wireline 130 is being pulled to surface there may be a need to ensure that any excess fluid is removed before the wireline 130 exits the wellbore to prevent drips and spillage at the surface. In order to substantially reduce the amount of fluid carried by the wireline 130, the wiper 60 can be urged into contact with the wireline 130 to remove excess fluid. This is achieved by injecting a hydraulic fluid through the port 128 into the chamber 126. Fluid in the chamber 126 acts against the piston head 121 to urge upward movement of the piston 120 and hence the attached seal cone 70 against the bias of the spring 80 to force the wiper 60 into contact with the wireline 130 to remove excess fluids therefrom. The funnel 50 is shaped to collect any remaining drips from the wireline 130 that are then recovered through the port 52 and recycled if required.

The deflector insert 20 is advantageously provided as a separate component that is coupled to the body 10. The deflector insert 20 and in particular, the impact surface 28 of the frustocone is prone to wear and can be easily removed and replaced because it is separable from the body 10. This also applies to the nozzle insert 30 if it is damaged or suffers wear.

Ideally, the nozzle 31 should be sized to suit a large range of wireline diameters, thus, eliminating the need for bespoke equipment depending on wireline diameter. However, the fact that the deflector insert 20 and the nozzle insert 30 are separate components that together determine the shape of the nozzle 31 through which the working fluid is directed (and hence the fluid speed) allows the dimensions of the channel to be easily altered for different applications or ranges of wireline 130 size. For example, the nozzle insert 30 can be removable so that it may be replaced by a nozzle insert 30 having a steeper annular sidewall 35 to vary the speed of the fluid exiting the nozzle. Therefore, several different deflector inserts 20 and nozzle inserts 30 can be provided having differently sized throughbores 23, 33 to facilitate use of the apparatus with different sizes of wireline 130.

Figure 4:
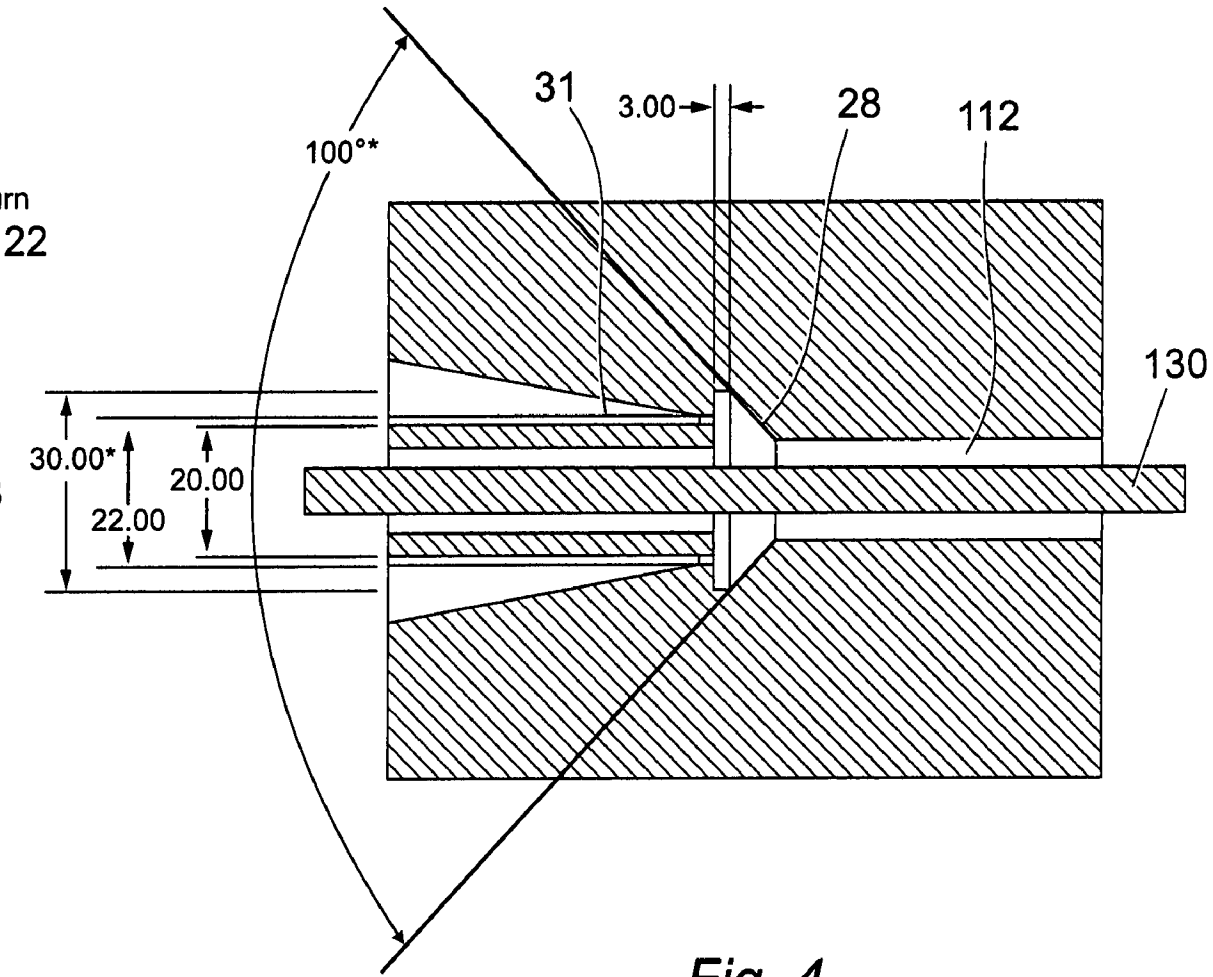
FIG. 4 is an alternative sectional view of the nozzle and the deflector of the FIG. 1 apparatus.
Figure 3:
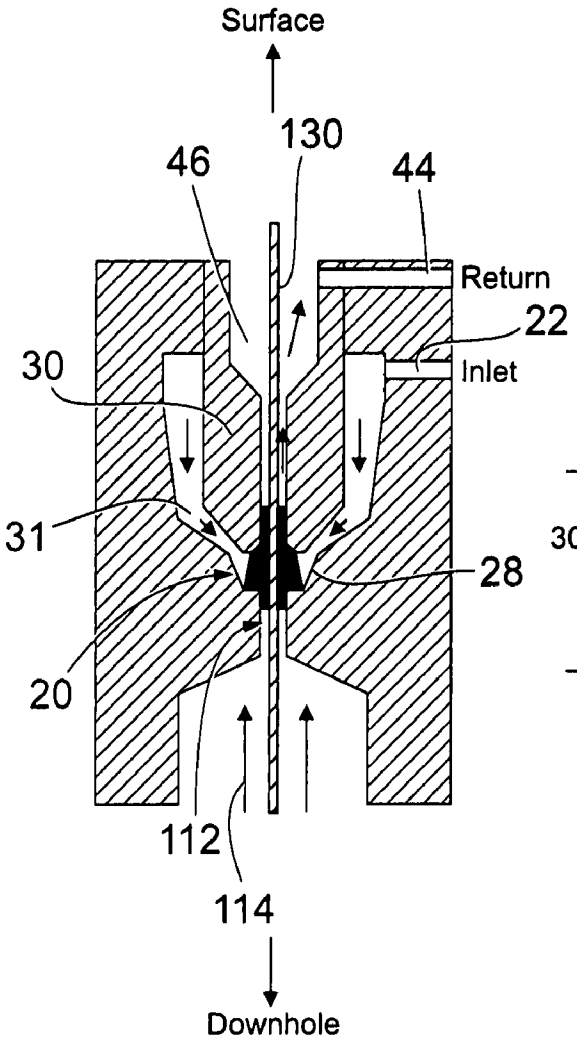
FIG. 3 is a sectional schematic view of the nozzle and the deflector shown in FIG. 2.
Figure 6:
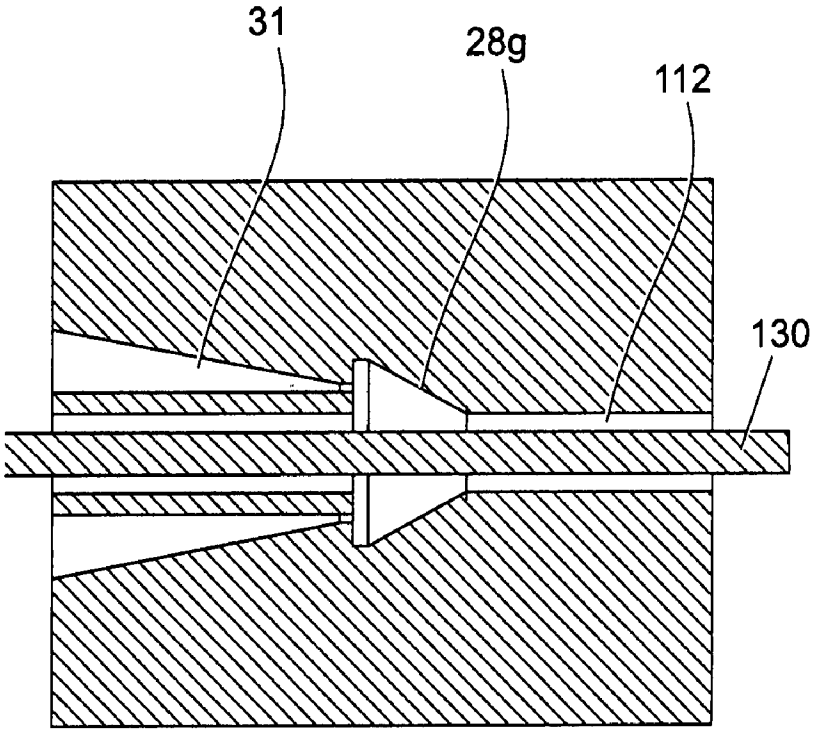
FIG. 6 is a sectional view of the nozzle and another alternative deflector.
Figure 5:
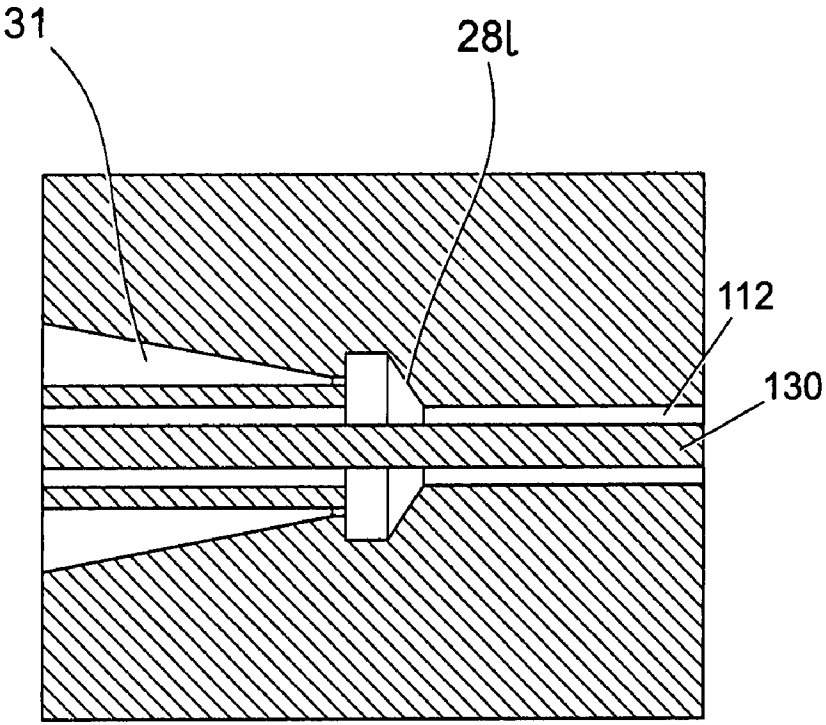
FIG. 5 is a sectional view of the nozzle and an alternative deflector.

According to other embodiments, the shape of the impact surface 28 and the geometry of the confined area can be modified to obstruct the fluid flow to create the back pressure and deflect the fluids to the desired region around the wireline 130. As shown in FIG. 4 the cone angle of the impact surface 28 is 50° relative to the axis of the wireline 130. This is the preferred embodiment. Alternatively, a steeper cone angle may be used, as shown in FIG. 6, where the cone angle of an impact surface 28*g* is 25° from the axis of the wireline 130. The 50° cone angle provides a more consistent pressure region in the area of the wireline 130. According to another alternative arrangement, a lens shaped or concave surface 281 can be provided. The lens shaped surface 281 has the advantage that the smooth edges reduce the risk of cavitation caused by the turbulent flow of fluid.

Modifications and improvements can be made without departing from the scope of the present invention. For example, the nozzle 31 is not required to be concentric. Instead, individual nozzle outlets can create individual jets of fluid flow that create the same cumulative effect by forming a pressure plug in the annulus. The working fluid is not limited, to water and can be any suitable fluid that has a viscosity below around 10 centipoise (0.1 Pa s).

Following from the above description and invention summaries, it should be apparent to those of ordinary skill in the art that, while the methods and apparatuses herein described constitute exemplary embodiments of the present invention, the invention contained herein is not limited to this precise embodiment and that changes may be made to such embodiments without departing from the scope of the invention as defined by the claims. Additionally, it is to be understood that the invention is defined by the claims and it is not intended that any limitations or elements describing the exemplary embodiments set forth herein are to be incorporated into the interpretation of any claim element unless such limitation or element is explicitly stated. Likewise, it is to be understood that it is not necessary to meet any of all of the identified advantages or objects of the invention disclosed herein in order to fall within the scope of any claims, since the invention is defined by the claims and since inherent and/or unforeseen advantages of the present invention may exist even though they may riot have been explicitly discussed herein.

What is claimed is:

1. A method for containing fluid in an area of a wellbore annulus, the method comprising the steps of:

(a) energizing a working fluid to create a high velocity jet of working fluid;

(b) at least partially obstructing the high velocity jet of working fluid; and (c) directing the high velocity jet of working fluid to form in the annulus a localized area of high pressure to contain fluid in an area of the annulus of lower pressure.

2. The method of claim 1, wherein step (b) creates a back pressure in said localized area of the annulus, the back pressure being sufficiently high to contain fluid in the wellbore annulus.

3. The method of claim 1, wherein the method includes deflecting the working fluid flow to generate a pressure plug in the area of higher pressure.

4. The method of claim 3, wherein the method includes shaping a surface for deflecting fluid to a predetermined region in the annulus and thereby facilitate creating the area of higher pressure.

5. The method of claim 1, wherein the method includes selecting a working fluid having a viscosity of less then 10 centipoise (0.1 Pa s).

6. The method of claim 1, wherein the method includes circulating the working fluid into and out of said area for maintaining the area of high pressure spatially and over a period time.

7. The method of claim 1, wherein step (a) includes increasing the speed of the working fluid to between 20-600 m/s in the annulus.

8. The method of claim 1, wherein step (b) includes impeding the flow path of the energized fluid.

9. The method of claim 1, wherein step (b) includes partially confining the working fluid in a chamber.

10. The method of claim 1, wherein steps (b) and (c) are performed simultaneously.

11. The method of claim 1, wherein the method includes a further step (d) of collecting the working fluid the localized area of higher pressure dissipates to the ambient pressure.

12. The method of claim 11, wherein the method includes recycling the working fluid in step (d) by performing step (a) on the collected working fluid.

13. The method of claim 1, wherein step (b) includes at least partially confining the energized fluid in a predetermined area of the annulus.

14. An apparatus for containing, a fluid in a wellbore annulus comprising:

a means for energizing a fluid to form a high velocity jet of working fluid;

an obstruction in the form of a shaped surface adapted to obstruct the flow of the energized working fluid when the jet is impacted against the shaped surface; and means for directing the high velocity jet of working fluid to the wellbore annulus to create in the annulus a localized area of high pressure sufficient to contain fluid in an area of the wellbore annulus of an ambient pressure.

15. The apparatus of clam 14, wherein the means for energizing the fluid includes a channel having a fluid in and a fluid outlet wherein the channel has a smaller sectional area in the region of the outlet than that of the inlet to increase fluid velocity in the region of the outlet for jetting the working fluid into the localized area of high pressure.

16. The apparatus of claim 14, wherein the working fluid is a low viscosity, water-based fluid.

17. The apparatus of claim 14, wherein the apparatus includes a throughbore adapted to receive a line therethrough, and the obstruction is positioned to generate high pressure in an annular space between the throughbore and the line.

18. The apparatus of claim 14, wherein the obstruction and the directing means together define a geometry which interacts with the energized working fluid permitting sufficient pressure build up to generate a pressure plug in the annulus from the energized working fluid.

19. The apparatus of clan 18, wherein the obstruction includes a surface in the path energized fluid flow at an angle relative to the direction of fluid flow for deflecting the fluid toward the annulus to generate the area of high pressure.

20. The apparatus of claim 19, wherein the surface is cone-shaped in section.

21. The apparatus of claim 20, wherein the surface is lens-shaped.

22. The apparatus of claim 14, wherein the apparatus is incorporated into a pressure control head for wellbore tubing.

23. The apparatus of claim 22, wherein the pressure control head includes a main body having an axial throughbore for receiving a wireline therethrough, and an insert, wherein the main body and the insert together form a symmetrical concentric nozzle for producing an annular jet of energized fluid to an annular space defined between an inner surface the pressure control head and the wireline to provide a pressure seat against the wireline.

24. The apparatus of claim 23, wherein the insert is removably attached to the main body for facilitating maintenance.

25. A method for containing fluid at pressure in a wellbore annulus, the method comprising the steps of directing a high velocity jet of a working fluid to the annulus and impacting the high velocity jet against a shaped surface to obstruct the flow of the high velocity jet to create in the annulus an area of sufficiently high pressure to retard escape of fluid from within an area of the wellbore annulus of lower pressure.

26. A method for containing pressure within an annulus of a wellbore including the steps of:

providing a high velocity jet of a working fluid having a predetermined minimum velocity; and impacting the high velocity jet of the working fluid against a shaped surface such that the impact creates a back pressure sufficient to contain fluids within the annulus of the wellbore.

* * * * *